United States Patent [19]

Baron

[11] Patent Number: 4,700,783

[45] Date of Patent: Oct. 20, 1987

[54] METHOD AND APPARATUS FOR RECOVERING LIQUIDS FROM A WELL BORE

[76] Inventor: Paul C. Baron, 3612 Watchill Rd., Munhall, Pa. 15120

[21] Appl. No.: 746,712

[22] Filed: Jun. 20, 1985

[51] Int. Cl.[4] ..... E21B 34/08; E21B 43/12

[52] U.S. Cl. ..... 166/372; 166/325; 166/373; 417/121

[58] Field of Search ..... 166/320, 321, 324, 325, 166/372, 373, 386, 370; 417/121, 65, 54

[56] References Cited

U.S. PATENT DOCUMENTS 3,371,717 3/1968 Chenoweth ..... 166/320 X
3,474,859 10/1969 Chenoweth ..... 166/320 X
4,273,186 6/1981 Pearce et al. ..... 166/324 X

*Primary Examiner*—Stephen J. Novosad
*Attorney, Agent, or Firm*—Carothers and Carothers

[57] ABSTRACT

A well bore is provided with novel and improved apparatus for practice of an improved method for recovery of liquids from the well wherein a quantity of liquid is elevated by repeated discrete steps upwardly through the well bore under the impetus of gas pressure with the size of the elevation steps being determined by the magnitude of gas pressure available in the well and wherein each level or step in the well is substantially continuously exposed to ambient atmospheric pressure whereby no substantial resistance to the stepwise upward flow of liquid is encountered.

14 Claims, 4 Drawing Figures

METHOD AND APPARATUS FOR RECOVERING LIQUIDS FROM A WELL BORE

BACKGROUND OF THE INVENTION

In the art of recovery of liquid and gaseous hydrocarbon fuels from wells, it is well known that a well often may not evolve enough natural pressure to drive the oil or gas to the well head at rates suitable for economic production. For example, low pressure gas wells can and do produce economically for long periods of time, but may become blocked by ground liquids seeping into the well bore. Even though the well may evolve sufficient pressure and volumes of gas to percolate the gas through the liquid blockage, the production rate of the well will nevertheless be diminished by the blockage. If the well cannot evolve sufficient pressure to percolate the gas through the liquid blockage at production rates, external apparatus is often used to clear the liquid blockage.

In low pressure oil wells, the evolution of natural pressure typically may be insufficient to drive the oil to the surface. One pound of gas pressure will support a column of oil about 2 ½ feet high. Therefore, the natural production capability of an oil well is a function of both natural well pressure and well depth. For oil wells with limited or negligible natural production capacity, such external means as pumps or the application of compressed air to the well are commonly utilized to facilitate production.

Many such low pressure oil and gas wells have sufficient pressure to lift a column of liquid through a limited distance and the applicant herein is aware of existing concepts for the lifting of liquids in well bores by natural well pressure which it utilized to lift a column or slug of liquid through a succession of adjacent, vertically extending sections of the well bore.

BRIEF SUMMARY OF THE INVENTION

The present invention concerns both novel method and apparatus for the practice of a sequential lifting procedure whereby a low pressure gas well may spontaneously clear liquid blockages such as above described, and low pressure oil wells may produce spontaneously, even though the natural well pressure be otherwise insufficient for spontaneous production.

The apparatus of the invention includes a serial plurality of valve assemblies positioned at spaced intervals in a well pipe string that is installed in a well casing. The pipe string extending between each pair of adjacent valves constitutes a stage of the well bore which is able to receive liquid from the subjacent stage. Each valve is operable individually and is cooperable with other such valves in a manner to provide for substantially continuous open communication between the stage directly beneath and the ambient atmospheric pressure such that an airlock or other pressure obstruction to the elevation of liquid through the successive stages of the well bore cannot develop.

The valve structures preferably comprise poppet valves having valve spindles or spools which are actuated by the rising level of the liquid being elevated such that the valve opens upon immersion of the valve spindle in the rising liquid. The valve spindle may be adjustably biased toward its closed position by an adjustable spring or other biasing means to regulate the opening and closing of the valve in response to the liquid level in the subjacent pipe section.

Well pressure is applied to the liquid in each stage to lift the liquid upwardly through the valve directly above and into the next stage of the pipe string, where the lifting process is then repeated. The liquid is thus lifted through a sequence of stages until it reaches the well head at the surface. The invention is intended primarily to operate under the impetus of naturally evolving well pressure, but of course is likewise operable under conditions wherein the natural pressure is supplemented by an external pressure source.

It is therefore one general object of the invention to provide a novel and improved method and apparatus for elevating liquids thriough a plurality of vertically adjacent well stages.

A more specific object of the invention is to provide a novel and improved method and apparatus for lifting liquids by stages vertically through a segmented well pipe string wherein each stage or segment of the pipe string is substantially continuously exposed to ambient atmospheric pressure and is maintained in controlled, intermittent fluid communication with the adjacent stages or segments of pipe by intervening valves which are actuated upon immersion of a portion of the valve in the liquid being elevated to allow the rising liquid level to pass from a subjacent stage through the valve and into the pipe stage directly above.

These and other objects and further advantages of the inention will be readily understood upon consideration of the following detailed description and the accompanying drawings in which.

Figure 1:
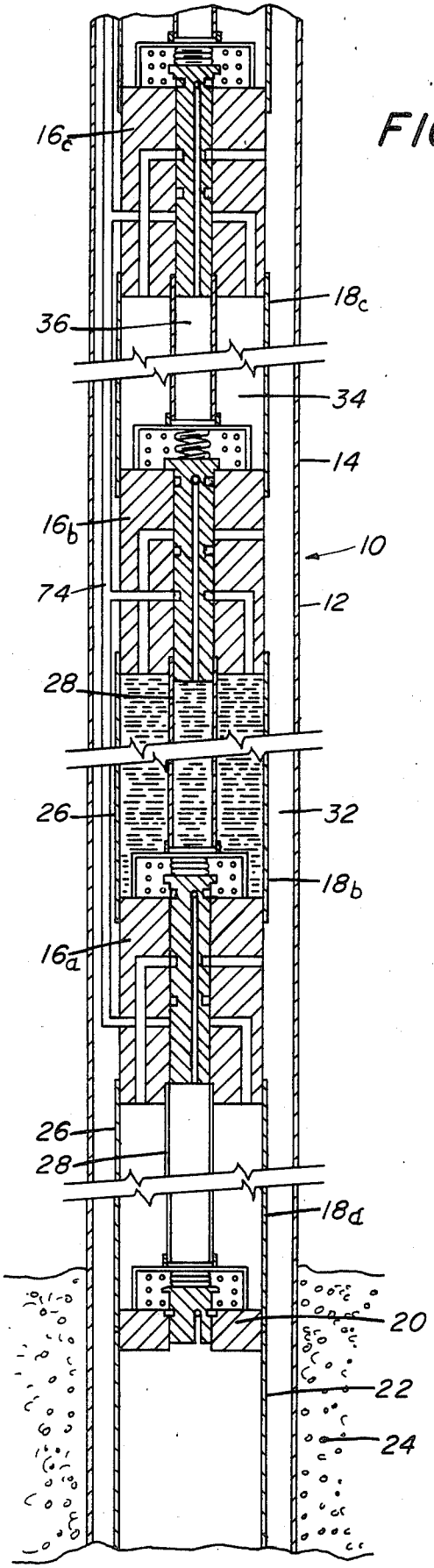
FIG. 1 is a fragmentary sectioned side elevation of a liquid lifting apparatus of the present invention.

There is generally indicated at 10 in FIG. 1 an apparatus according to one presently preferred embodiment of the invention. Apparatus 10 is installed within the well casing 12 of a well bore 14. Typically, such a well bore is drilled to permit recovery of subterranean oil and/or natural gas, although it will be understood that the invention may be utilized in conjunction with recovery of any subterranean fluid resource, whether gas or liquid, for the purpose of elevating liquids in the well bore. Furthermore, although the invention is intended primarily to utilize limited natural pressure resources to perform greater resource recovery work than such limited pressure would otherwise accomplish, it is to be understood that the invention is equally well suited to provide enhanced resource recovery from an intentionally limited external pressure source.

The apparatus 10 comprises a serial plurality of valve assemblies 16 (labeled as 16*a*, 16*b* and 16*c* in FIG. 11 which are spaced longitudinally apart within casing 12 at predetermined intervals, and intervening elongated pipe sections 18*a*, 18*b*, 18*c* which extend continuously intermediate each pair of adjacent valves 16. Apparatus 10 includes a lower end inlet valve 20, and a terminal pipe section 22 which extends within casing 12 below valve 20 and into the producing zone 24 of the well bore 14. As is well known, the casing 12 and terminal pipe section 22 are suitably perforated at locations within production zone 24 to admit oil flow thereinto. Such perforations typically may be located deep within the production zone 24 and therefore are not shown in FIG. 1, which illustrates only an uppermost part of the production zone 24.

The top end of the well bore is provided with a conventional well head (not shown) which cooperates with the apparatus 10 and casing 12 to permit resource recovery from the well and to provide ventilation for the well as will be described.

Figure 2:
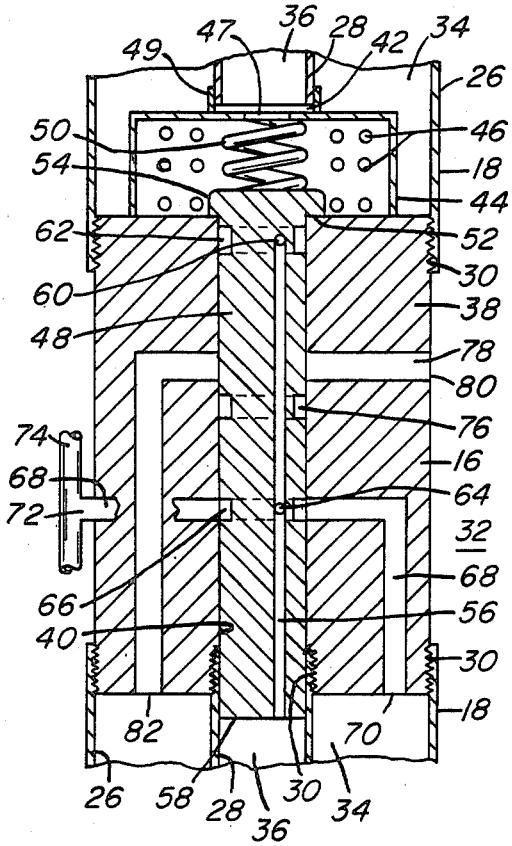
FIG. 2 is a fragmentary portion of the FIG. 1 showing schematically a valve of the invention in its closed configuration.
Figure 3:
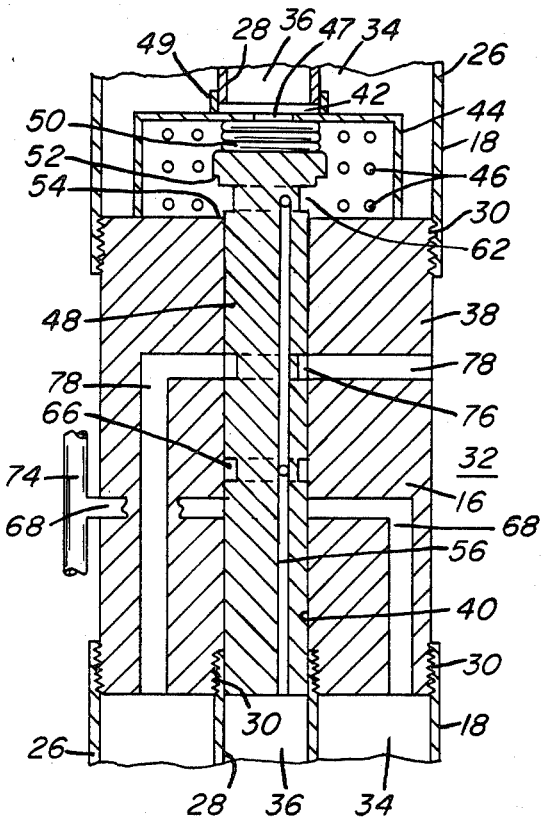
FIG. 3 is a view similar to FIG. 2 showing the valve in its open configuration.

Referring to FIGS. 1, 2, and 3, each pipe section 18 comprises a pair of coaxially extending pipes including an outer casing pipe 26 and an inner producing pipe 28. Each of pipe elements 26 and 28 is releasably affixed in mutually coaxial relationship as by the threaded engagements indicated at 30 with a pair of valves 16, or with a valve 16 and the valve 20 in the casse of the lowermost end of the final pipe section 18. Terminal pipe section 22 is connected to and extends beneath valve 20.

The well casing 12, assembly casing 26 and producing pipe 28 provide mutually coaxial well passages including an outer annual passage 32 which extends longitudinally throughout the well bore radially intermediate casings 12 and 26, an inner annular passage 34 which extends longitudinally intermediate each pair of adjacent valves 16 (or valves 16 and 20) radially intermediate assembly casing 26 and producing pipe 28, and a central producing passage 36 which extends within producing pipe 28.

As shown in FIGS. 2 and 3 (which are to be understood as schematic representations) each valve 16 comprises a rigid body member 38 which is releasably affixed to the adjacent pipe sections 18 by threads 30 as above described. A longitudinal through bore 40 extends within body 38 and openly communicates adjacent its lower end with passage 36 within the subjacent pipe 28. The upper end of bore 40 openly communicates with both of the passages 34 and 36 in the pipe section 18 directly above it. A perforated spring cage 44 is affixed atop valve body 38 such that the fluid communication between passages 34 and 36, and the upper end of bore 40 occurs via perforations 46 and an opening 47 in spring cage 44. An upwardly extending annular flange portion 49 of cage 44 captures the lower end of the adjacent pipe 28 as shown.

An elongated, generally stepped cylindrical valve spool 48 is slidably disposed within bore 40 and is movable axially therein between a closed position as shown in FIG. 2 and an open position as shown in FIG. 3. A suitable biasing spring 50 or other biasing element may be captively retained within spring cage 44 coaxially intermediate the top of spool 48 and the ceiling of cage 44 to supplement the weight of spool 48 in urging spool 48 toward its closed position where annular shoulder 52 of the spool 48 sealingly engages a cooperating seat portion 54 of body 38.

Spool 48 includes fluid flow control ports and passages which register with cooperating passages in valve body 38 during operation of valve 16 as follows. When valve 16 is closed (FIG. 2) shoulder 52 of spool 48 is in sealing engagement with seating surface 54. A blind bore 56 extends within spool 48 from its lower end 58 to a transverse passage 60 which communicates openly with an annular groove or undercut 62 formed downwardly adjacent to shoulder 52. Thus, when spool 48 is in the closed position, fluid communication via bore 56 from the subjacent producing passge 36 up to the next succeeding pipe section 18 is cut off.

Another transverse passage 64 communicates openly between bore 56 and an annular vent groove 66 formed in spool 48. When valve 16 is closed, groove 66 registers in open fluid communication with a ventilation passageway 68 formed in body 38. One end 70 of passageway 68 openly communicates with the passage 34 in the subjacent pipe ssection 18, and the other end 72 of passage 68 communicates with a ventilation conduit 74 which, as shown in FIG. 1, extends throughout the longitudinal extent of apparatus 10 in the annular outer passage 32 and is continuously openly vented to the ambient atmosphere, preferably at the well head (not shown). Accordingly, when any valve 16 is closed, both of the subjacent passages 34 and 36 are continuously, openly ventilated via conduit 74 to the atmosphere.

Thus it will be seen that each passage 34 is selectively exposed to atmospheric pressure or well pressure via the valve 16 at its upper end, while the corresponding passage 36 is exposed continuously to atmospheric pressure via the same valve via passages 56, 64, 66, 68, 74, when the valve 16 is closed, or via passages 56, 60, 62 and the next upward pipe section 18 when the valve 16 is open. Even if the pipe sections 18 on both sides of a given valve 16 are filled solid with oil, the lower passage 36 will be exposed to atmospheric pressure if the valve 16 is open due to the uniform transmission of pressure through a confined fluid.

Spool 48 includes another annular groove 76 which, when valve 16 is closed, is out of registry with a cooperating passage 78 formed in body 38. One end 80 of passage 78 openly communicates with the annular outer passage 32, and the opposite end 82 of passage 78 openly communicates with the subjacent passage 34. As mentioned, when valve 16 is closed, groove 76 is out of registry with passage 78 and the passage 34 thus is isolated from well pressure which evolves within passage 32. Of course, it will be understood that passage 32 is continuously maintained at elevated pressure by such natural evolution of well gases and/or by supplemental externally applied pressure.

For valve 16 to open, spool 48 must be lifted against the gravitational resistance of its own weight, and the bias of spring 50 if provided, to the position of FIG. 3. In the open position, groove 62 openly communicates with the interior of spring cage 44 to permit open fluid flow from the subjacent passage 36 via bore 56 and into the passages 34 and 36 of the pipe section 18 directly above. Groove 66 moves out of registry with passage 68 thus blocking flow therethrough and through passage 64, such that both of the subjacent passages 34 and 36 are isolated from ventilation conduit 74. Further, groove 76 moves into registry with passage 78 thus exposing the subjacent passage 34 to the pressure in passage 32.

Spool 48 may be a flotation element whereby it will be lifted from its closed position in part by the impetus of its own buoyancy in the liquid being elevated. Thus, when the liquid level in the subjacent spaces 34 and 36 reaches spool 48 and continues to rise, this buoyant effect and/or the pressure of the rising liquid lifts the spool 48 from the closed position to the open position. Of course, in the case of a flotation spool, the buoyance of the spool must be matched carefully to its weight and the force/deflection characteristic of any retention spring utilized. Accordingly, such expedients as an air bulb (not shown) carried by spool 48 adjacent its lower end for example, might be employed to assure proper spool response to rising liquid level. It is also to be noted that spool 48 need not necessarily be a bouyant element, if for example the impetus of the fluid flow forces and volume flow rates of the rising liquid level are sufficient to lift the spool 48, or if the pressure differential across the valve is sufficient to shift the spool 48 to its open position.

It will be appreciated that valve spool 48 must be operable in a variety of well conditions, including in particular the condition wherein the pipe section directly above the valve is empty and vented to atmosphere while the pipe section directly below the valve is filled with liquid at well pressure, and also the condition wherein both of the pipe sections directly above and directly below the valve are filled solid with liquid. Accordingly, the size of the pressure responsive surface areas of the valve spool, its buoyancy in the liquid to be recovered, and its response to the fluid flow forces and the force/deflection characteristic of spring 50, all must be selected judiciously to insure proper valve operation under all anticipated conditions.

Figure 4:
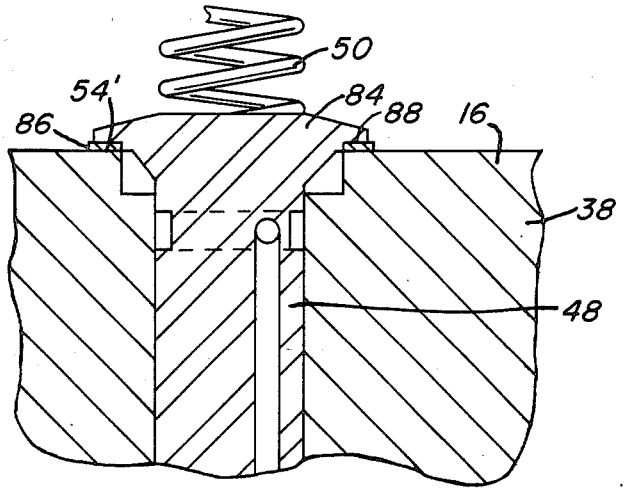
FIG. 4 is a sectioned side elevation showing an alternative valve spool structure.

An alternative embodiment of the upper end of spool 48 is shown in FIG. 4 are comprising an enlarged head portion 84 which carries an annular seal member such as a suitable resilient sealing washer 86 adjacent an underside seating surface 88 thereof such that when valve 16 is closed the washer 86 is in face sealing engagement with valve body seating surface 54' and with seating surface 88.

From the above description, the operation of the disclosed apparatus will be understood. The following description of the operation of apparatus 10 is intended to constitute not only further structural disclosure but also disclosure of the method of the present invention.

Initially, the natural pressure of the well is operative to support a column of liquid (e.g. oil) within spaces 34 and 36 of a well pipe 18*a, b* or *c*, in much the same manner that the pressure differential between ambient and contained pressure in a U-shaped barometer glass supports a column of water. Passages 36 are continuously exposed to atmospheric pressure as above described, the elevated well pressure will drive a column of oil to a predetermined elevation within each well pipe sections 18*a, b* and *c*. The column of oil may extend through a plurality of the well pipe sections 18 and the associated valves 16*a, b, c,* but is at least the height of the first such pipe section 18*a* such that a sufficient oil level will be produced by the well pressure to lift the valve of valve 16*a* at the top of the pipe section 18*a*. It will be understood that initially all of valves 16 are in the closed position as shown in FIG. 2. Thus, as the oil level rises in the first pipe section 18*a* under naturally occurring well pressure impetus to lift the valve spool 48 of valve 16*a* directly above, a fluid flow path for the oil from passage 36 below is established via bore 56, passage 60, and groove 62 of valve 16*a* into passages 34 and 36 of the section 18*b* directly above valve 16*a*. At the same time, groove 76 is shifted into registry with passage 78 to thereby expose the passage 34 of pipe section 18*a* directly below valve 16*a* to well pressure from annular passage 32. Accordingly, the oil in passages 34 and 36 of pipe section 18*a* is subjected on one upper surface portion thereof (in passage 34) to well pressure, and on the other upper surface portion thereof (in passage 36) to atmospheric pressure. The well pressure thus forces the confined oil downward in passage 34 and upward via passage 36 through valve 16*a* and into passages 34 and 36 of pipe segment 18*b* directly above.

It should be noted that although the oil level in passage 34 will reliably descend to the bottom of the passage under the impetus of well pressure, the well pressure will continue to push the oil column up passage 36 only if the surface cohesion of the oil, and the cross-sectional area of the passage 36, are such that, given the rate of well gas flow within the passages 34 and 36, the column of oil may actually be supported on top of the gas cushion without allowing any substantial quantity of the gas to percolate up through the oil column. If the cross-sectional area of passage 36 is too large, or the gas flow rate is too small the gas/oil interface surface cohesion may fail and the gas will percolate up through the oil in passage 36 rather than pushing the oil ahead of it. The result may be loss of actuating impetus on the spool of valve 16*a*, in which event the valve would close thus terminating the oil elevation cycle. Therefore, under these circumstances, the oil would be elevated in smaller amounts by shorter and more frequent cycles than under conditions which would permit complete emptying of pipe section 18*a* into the next upwardly adjacent pipe section 18*b*. It is believed that either operating mode will produce satisfactory results. Most notably, throughout the elevation process, the well pressure is maintained on the trailing surface the column of oil being elevated and ambient atmospheric pressure is maintained on the leading surface of the oil being elevated.

As noted, the well pressure should be of a magnitude to support a column of oil of sufficient height to assure the oil column will actuate the next valve 16*b* and thus repeat the lifting process in the next stage of the well. However, under the conditions described in the preceding paragraph, it may take more than one elevating operation in a given stage of the well to fill the next higher stage and thereby initiate the elevation process in that next stage. Accordingly, a quantity of oil is elevated by steps from one pipe section 18*a* to the next section 18*b* under the impetus of well pressure in any section 18 (e.g. section 18*b*). The applied well pressure cannot force the oil to backflow through the subjacent valve 16*a* under any circumstances because that valve will normally be closed. The subjacent valve 16*a* cannot open unless the next lower pipe section 18*a* is filled with oil, and the well pressure or the closed valve 20 which supports the oil in the pipe section 18*a* would thus cancel the downwardly directed well pressure which is performing the elevating function in the upwardly adjacent pipe section 18*b*. Accordingly, oil backflow is not possible.

The above description is an initial conditions case. In a more generalized case, the well may have extended segments of one or more pipe sections 18*a, b, c* that are filled with oil, and other intervening segments of pipe that are empty. Additionally, the uppermost one of the pipe sections in any oil filled segment of the well may be only partially full. Under these generalized conditions, it will be seen that at some location in the well there will of necessity be at least one valve 16 from which there extends upwardly a column of oil of a height that is less than the column height which the well pressure will support. Even if the well is filled solid with oil to the well head, this condition will be satisfied by the oil in the topmost pipe section since each pipe section is shorter than the column length that the well pressure will spontaneously support. The initial generation of such a column of oil is assured by judicious matching of the length of pipe segments 18 to the natural column height support capacity of the well pressure, as above described. For any such critical height column of oil, the mechanics of the system above described will cause at least one valve 16 intermediate the ends of the oil column to open, thus exposing the oil in space 34 directly beneath that valve to well pressure and opening a flow passage from the associated passage 36 to the next higher pipe segment 18 via the open valve. The oil thus is urged down the passage 34, up through the associated passage 36, and into the next higher pipe section 18 under the impetus of the natural tendency of the well pressure to lift the oil until it reaches the maximum column height the well pressure can support. Because the next higher pipe section is exposed to atmospheric pressure (via passages 68 and 74 or via spool passage 56 communicating with the next upward one or more pipe segments 18) the pressure differential between atmospheric and well pressure assures that the oil column will be elevated in response to the natural ability of the well pressure to support a column of a given height.

Inasmuch as the oil column is being elevated in steps through the pipe string and the same operative conditions, including the specified pressure differentials, prevail throughout the length of the well bore, the oil column will be elevated by steps in the manner described until it reaches the surface.

Operation of the invention will be further clarified by considering a single pipe segment, say section 18*b*, that is filled solid with oil, given that the design perameters of the system assure that natural well pressure is sufficient to fill at least one such single pipe section 18*b*. As the upper surface of the oil column in the filled pipe section 18*b* immerses a portion of the valve 16*b* spool 48, the valve spool is lifted. Of course, the valve spool must lift before the oil level reaches the elevation of conduit 74 via passage 68 and thereby block the vent path. Therefore it is important that the valve spool extend far enough downward toward or even into the pipe 28 to assure valve opening. When the valve 16*b* spool 48 is lifted to open the associated pressure passage 78 of pipe section 18*b*, pressure impetus forces the oil to flow down through passage 34, upward through passage 36, and then via valve 16*b* into the next higher pipe section 18*c* as has been described. For each such elevation step, if the value 16*a* at the lower end of the pipe section 18*b* initially is open, as when oil is flowing upward under the impetus of oil pressure applied in the next subjacent pipe section 18*a*, the upward and downward directed well pressures in pipe sections 18*a* and 18*b* will cancel thus reducing the pressure differential across the intervening valve 16*a* to nil and allowing the spindle 48 to close under the impetus of spring 50, if provided. For a buoyant valve spool element, it is believed the buoyancy should be substantially neutral so that the spool tends to neither rise nor sink when merely immersed in stationary or non-flowing oil. Such a spool will operate substantially as a one way check valve which opens and closes the ventilation and well pressure passages as described in response to fluid flow momentum and inertia.

It is repeated here for emphasis that the invention will operate with equal facility from either naturally evolving well pressure alone, from a combination of natural and artificial well pressure, or from artifically induced pressure alone. For example, an air compressor may be utilized to supply air pressure to passage 32 from the surface to thereby supplement whatever naturally evolving well pressure is available.

According to the description hereinabove there is provided by the instant invention a novel and improved method and apparatus for lifting liquids in an elongated, vertically extending well bore. Of course, various alternative and modified embodiments would readily occur to those versed in the art, as indeed such have to the inventor hereof. For example, in wells having the well pipe string joints cemented, the passage 32 would have extending therein, through the zones of cementing, conduit or other open flow paths traversing the cemented zones to assure well pressure will reach all valves 16. Such a conduit might be, for example, an elongated run of pipe extending within passage 32 throughout the cemented zone only and connected by a T-connection to the pressure passage 78 in each respective valve 16.

These and other alternative and modified embodiments having been envisioned and anticipated by the inventor, it is intended that the invention be construed as broadly as permitted by the scope of the claims appended hereto.

I claim:

1. In a well liquid recovery apparatus wherein an elongated vertically extending pipe string includes a plurality of valve means spaced vertically apart by elongated pipe sections, each of which pipe sections is subdivided to define therein a pair of vertically coextensive chambers whereby a body of liquid contained therein comprises a pair of upper surface portions of such body of liquid, and each said valve means is operable in response to the level of such a body of liquid contained within the pipe section directly subjacent thereto to expose one of said upper surface portions of the contained liquid to well pressure in a manner that the well pressure moves the contained liquid upwardly via the respective said valve and into the pipe section directly above said valve, and wherein each said valve is operable to prevent backflow of liquid from the pipe section directly above the pipe section directly below said valve, the improvement comprising:

the interior of each of said pipe sections being maintained in substantially continuous open fluid communication with the ambient atmosphere via a vent path including passages in the valve directly upwardly adjacent said pipe section such that a body of liquid contained within said interior of said pipe sections is continuously exposed to ambient atmospheric pressure.

2. The improvement as claimed in claim 1 wherein said pair of vertically coextensive chambers are connected together adjacent their lower ends and the respective valve upwardly adjacent the respective said pipe section is operable to selectively vent the upper ends of said passages to ambient atomspheric pressure via a direct vent passage to the ambient atmosphere.

3. The improvement as claimed in claim 2 wherein both of said chambers are vented via said direct vent passage to the ambient atmospheric pressure when the respective said valve is closed to liquid flow therethrough.

4. The improvement as claimed in claim 3 wherein said upper end of one of said chambers is isolated from ambient atmospheric pressure and the upper end of the other of said chambers is exposed to ambient atmospheric pressure when the respective said valve is open to liquid flow therethrough.

5. The improvement as claimed in claim 4 wherein each respective valve is operable when open to liquid flow therethrough to direct well pressure to thereby urge liquid contained in said subjacent pipe section to flow via the respective said one and said other chambers and said respective valve into the pipe section directly above said respective valve.

6. In a well liquid recovery apparatus which includes an elongated pipe string that extends within a generally vertically extending well bore and which is adapted for use in recovery of liquids from such a well bore, the combination in said pipe string comprising:

a plurality of valve means disposed at vertically spaced locations within such a well bore;

an elongated pipe section extending intermediate each vertically adjacent pair of said valve means with the interior of each said pipe section being in fluid flow communication with the said valve means adjacent thereto;

a pair of elongated vertically coextensive chambers defined within each said pipe section;

each said pair of elongated chambers being in fluid communication with each other only at locations spaced vertically from the upper ends thereof;

a ventilation passage means selectively communicating between the ambient atmosphere and the upper ends of said pair of chambers in each said pipe section via the said valve means upwardly adjacent each respective said pipe secion;

a pressure passage means selectively communicating between regions of such well bore external to said pipe string and said upper end of one of said chambers in each said pipe section via the said valve means upwardly adjacent each respective said pipe section to admit elevated pressure into said upper end of said one chamber;

a fluid flow passage means selectively connecting the said upper end of the other of said chambers in each said pipe section, via the respective said valve means upwardly adjacent thereto, with the said chambers in said pipe section upwardly adjacent said respective valve means to permit selective fluid flow, under the impetus of elevated pressure applied in said upper end of said one chamber, via said other chamber into the said chambers in said pipe section upwardly adjacent said respective valve means;

each of said valve means being selectively operable in response to the level of liquid contained within said chambers of the respective subjacent said pipe section to maintain said one and said other chambers in continuous open communication with the ambient atmosphere via said ventilation passage means when said fluid flow passage means is closed and to expose said one chamber to elevated pressure via said pressure passage means when said fluid flow passage means is open; and said valve means being mutually cooperable to maintain the interior of each said pipe section in substantially continuous communication with ambient atmospheric pressure in a manner that all upward flow of liquid within each said pipe section is directed into said chambers within upwardly adjacent said pipe sections that are continuously exposed to ambient atmospheric pressure.

7. The combination as claimed in claim 6 wherein said ventilation passage means includes an elongated circuit means which extends externally of said pipe string throughout the extent of the well bore and openly communicates with the ambient atmosphere.

8. The combination as claimed in claim 7 wherein said conduit means selectively communicates via each said valve with the respective said pipe section subjacent thereto.

9. The combination as claimed in claim 8 wherein said conduit means extends within the said regions external to said pipe string with which said pressure passage means communicates.

10. The combination as claimed in claim 9 additionally including a well casing generally coaxially encompassing said pipe string to define therebetween said regions external to said pipe string, said regions being isolated from the ambient atmosphere and being in communication with the producing zone of the well to sustain natural well pressure continuously throughout the extent of said regions.

11. The combination as claimed in claim 7 wherein each said fluid flow passage means includes a portion of the respective said ventilation passage means communicating with the respective said other chamber.

12. In a method for recovering liquids from an elongated, vertically extending pipe string within a well bore wherein a volume of liquid within the pipe string is elevated in discrete steps upwardly through the pipe string by application of pressure to the volume of liquid at discrete vertical intervals corresponding to said discrete steps upon opening of vertically spaced valves which are actuated in response to the rising level of the liquid within the pipe string produced by elevation of the volume of liquid in a preceding discrete step, the improvement comprising:

continuously venting the spaces within said pipe string immediately upwardly adjacent to the rising surface of said volume of liquid substantially continuously throughout said elevating thereof within said pipe string.

13. A method of elevating liquids within a vertically extending well comprising:

supplying a volume of liquid to a first vertically extending portion of said well;

venting said vertically extending portion of said well to the ambient atmosphere throughout said supplying step;

in response to the rising level of said volume of liquid within said first vertically extending portion, discontinuing said venting so as to expose only a selected upper surface portion of said volume of liquid to ambient atmospheric pressure;

concurrently with said exposing step, applying elevated pressure to another selected upper surface portion of said volume of liquid to establish a pressure differential which raises the elevation of said one selected surface portion with respect to said another selected surface portion to thereby elevate at least some of said volume of liquid into a second vertically extending portion of said well immediately above said first vertically extending portion; and resuming said venting upon termination of said applying elevated pressure step.

14. The method as claimed in claim 13 including the additional step of terminating said applying elevated pressure step within said first vertically extending portion in response to the level of said volume of liquid within said second vertically extending portion.

* * * * *